US007249389B2

(12) United States Patent
Russell

(10) Patent No.: US 7,249,389 B2
(45) Date of Patent: Jul. 31, 2007

(54) DUAL SIDE OPENING DUVET SLEEVE

(76) Inventor: Jennifer Russell, 1022 Warm Springs Ave., Boise, ID (US) 83712-7947

( * ) Notice: Subject to any disclaimer, the term of this patent is extended or adjusted under 35 U.S.C. 154(b) by 144 days.

(21) Appl. No.: 11/092,176

(22) Filed: Mar. 28, 2005

(65) Prior Publication Data

US 2006/0215355 A1 Sep. 28, 2006

(51) Int. Cl.
*A47G 9/02* (2006.01)
*A47G 9/04* (2006.01)

(52) U.S. Cl. ..... 5/502; 5/501; 5/490

(58) Field of Classification Search ..... 5/500–502, 5/482, 490, 922, 923
See application file for complete search history.

(56) References Cited

U.S. PATENT DOCUMENTS

| | | | | |
|---|---|---|---|---|
| 938,968 | A | 11/1909 | Caldwell | 5/501 |
| 1,394,061 | A * | 10/1921 | Bernstein | 5/690 |
| 2,248,768 | A * | 7/1941 | Licht | 5/485 |
| 2,505,027 | A | 4/1950 | Belsky | 5/501 |
| 3,241,161 | A | 3/1966 | Dashosh | 5/501 |
| 3,331,088 | A | 7/1967 | Marquette | 5/502 |
| 4,005,499 | A | 2/1977 | Klein | 5/485 |
| 4,839,934 | A * | 6/1989 | Rojas | 5/502 |
| 5,027,457 | A * | 7/1991 | Sweet | 5/640 |
| 5,187,825 | A * | 2/1993 | Tesch | 5/502 |
| 7,181,790 | B2 * | 2/2007 | Wirtz | 5/501 |
| 2005/0144721 | A1 * | 7/2005 | Linnane | 5/501 |
| 2005/0246838 | A1 * | 11/2005 | Wirtz | 5/501 |
| 2006/0112487 | A1 * | 6/2006 | Taylor | 5/490 |
| 2006/0215355 | A1 * | 9/2006 | Russell | 361/600 |

OTHER PUBLICATIONS

Gershman, Maurice, M.D. "Self-Adhering Nylon Tapes." Journal of A.M.A. (vol. 168, No. 7) Oct. 18, 1958.*

* cited by examiner

*Primary Examiner*—Robert G. Santos
(74) *Attorney, Agent, or Firm*—Robert L. Shaver; Dykas, Shaver & Nipper, LLP

(57) ABSTRACT

A duvet sleeve for covering and securing a duvet. The duvet sleeve is generally rectangular and includes two openings on opposite sides of the duvet sleeve. The presence of two openings instead of the typical one opening allows one person to change the duvet inside the duvet sleeve.

14 Claims, 2 Drawing Sheets

DUAL SIDE OPENING DUVET SLEEVE

BACKGROUND OF THE INVENTION

1. Field of the Invention

The present invention is in the general field of duvets, and more specifically is in the field of duvet covers for housing and securing duvets.

2. Background Information

A duvet sleeve is a type of bed linen in which a duvet, such as a quilt, a comforter, a blanket or the like is placed. Once placed inside the duvet cover, the duvet is placed on top of a bed typically to add warmth and comfort to the user of the bed.

The duvet enclosed within the duvet cover needs to be periodically removed from the duvet cover, so that the duvet and/or the duvet cover can be cleaned. Part of the purpose of the duvet cover is to protect a duvet such as a down comforter so that it needs to be washed less frequently. The typical duvet cover has one opening on one edge of its four corners into which the duvet is stuffed in order to insert the duvet into the duvet cover. To spread the duvet out evenly inside the rectangular duvet cover, one corner of the duvet is inserted into each of the four corners of the duvet cover, and then the four corners are pulled tight. Inserting the duvet into a duvet cover is a very cumbersome project for one person, and is much more easily performed with two people. With two people, the four corners of the duvet are inserted into the four corners of the duvet cover, and then the two people each hold one corner in each of their two hands, and pull and shake the duvet and duvet cover until the duvet is evenly distributed inside the duvet cover, with one corner of the duvet in each of the four corners of the duvet sleeve. The problem with a prior art duvet cover is that it is very difficult for one person to reinsert the duvet into the duvet cover, and cause it to be evenly distributed inside the duvet cover.

For this reason, it is a goal of the present invention to provide a dual side opening duvet sleeve design that facilitates placement of the duvet into the duvet sleeve by one person.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects are accomplished by the side opening duvet sleeve of the invention. The invention is referred to as a side opening duvet sleeve, whereas the single opening device of the prior art is referred to as a duvet cover, for clarity. The side opening duvet sleeve is designed for covering, securing and holding a duvet on a bed. The duvet can be a comforter, a quilt, a blanket or similar duvets. The side opening duvet sleeve of the invention is formed from two panels that are joined together. The panels are generally rectangular and are joined on certain edges, and certain sections of the edges are not joined together, leaving an opening on two sides of the duvet sleeve, usually on two opposite sides.

Each of the rectangular panels has an upper side and a lower side, and four edges. Being a rectangle, two of the edges form opposing edges, and the other two edges form a second pair of opposing edges. The edges are a top edge opposite a bottom edge, and a right edge opposite a left edge.

The duvet sleeve is constructed with two panels adjacent to each other, with the lower side of the first panel adjacent to the upper side of the second panel. The two panels adjacent to each other form a duvet sleeve interior, into which the duvet is inserted or removed. With the first and second panels positioned adjacent to each other, a pair of opposing edges of the first panel are joined with the corresponding opposing edges of the second panel. For instance, the top and bottom edges of the first panel may be joined to the top and bottom edges of the second panel. In another configuration the left and right edges of the first panel may be joined with the left and right edges of the second panel.

The second pair of opposite edges are at least partially unattached to the second opposite edges of the second panel. This forms a first and a second side opening in the opposing edges between the first and second panels. The side openings are closeable by a releasable mechanism, such as snaps or hook and loop fasteners, or by the use of zippers, or by the use of buttons. It is through the two side openings of the invention that the duvet is inserted or removed from the duvet sleeve interior.

The side opening duvet sleeve thus provides two openings for access to the duvet sleeve interior, preferably on opposite sides of the duvet sleeve from each other. The side openings are releasably closeable, such as by snaps, zippers, buttons, ties or hook and loop. The invention requires two side openings, which may also be on adjacent edges, such as on the left side and on the bottom side.

The side openings may be on the left and right edges, or alternatively they may be on the top and bottom edge. The width of the side openings may be variable, but one design that is successful is if the side openings take up approximately ⅓ or less of the edge in which it is formed.

The configuration of the two side openings on opposite edges of the duvet sleeve allows a duvet to be inserted or removed by one person. This procedure is very difficult for one person to do with the prior art duvet cover, which contains only one access opening on any side of the duvet cover.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
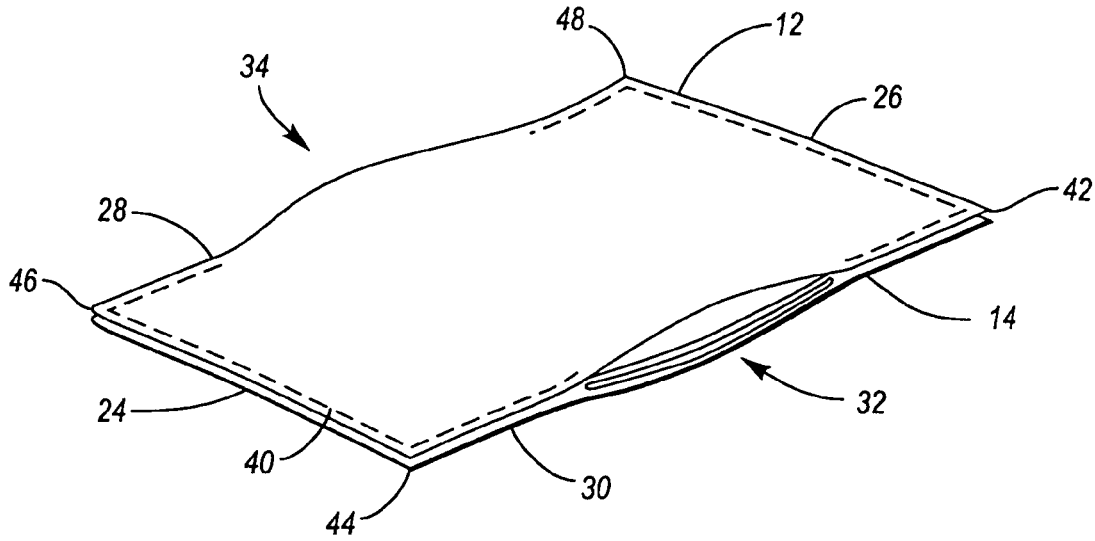
FIG. 1 is a perspective view of the side opening duvet sleeve of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

One preferred embodiment of the invention is illustrated in FIGS. 1-8. FIG. 1 shows the duvet sleeve 10 of the invention, which includes a first side opening 32 and a second side opening 34. The duvet sleeve 10 of the invention includes a first panel 12 and a second panel 14 that are joined along some, but not all of their edges. Stitching 40 is shown in FIG. 1 to indicate that the first panel 12 and second panel 14 are joined together, but such stitching is only representative of the areas in which the edges of this version of the duvet sleeve 10 are joined together.

The first panel 12 includes an upper side 16 and a lower side 18. The second panel 14 similarly includes an upper side 20 and a lower side 22. Both the first and second panels 12, 14 have a bottom edge 24, a top edge 26, a left edge 28 and a right edge 30. The edges of the two panels are completely joined along one pair of opposing edges. In FIG. 1, these opposite edges are the bottom edges 24 and the top edges 26. In other configurations, the completely joined edges could be left edges 28 and right edges 30. Other possible configurations could also include side openings on adjacent edges, such as the left and the bottom edge.

Figure 2:
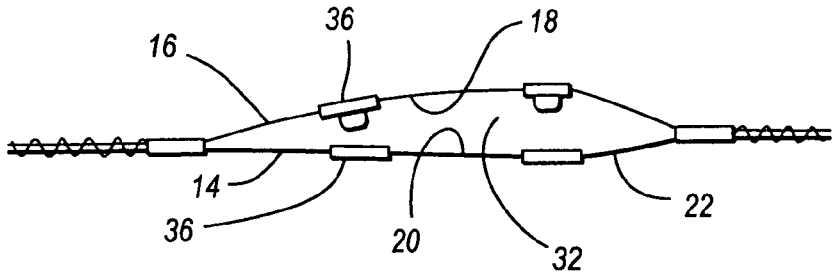
FIG. 2 is a side view of the side opening duvet sleeve of the invention showing a snap closure.
Figure 3:
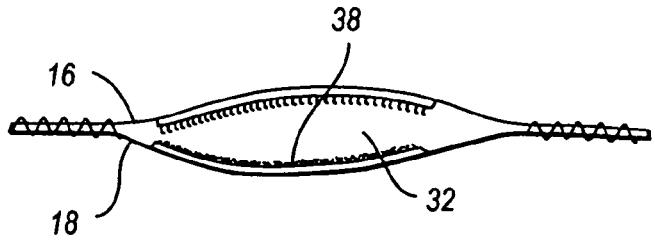
FIG. 3 is a side view of the side opening duvet sleeve of the invention showing a hook and loop type closure.

FIGS. 2 and 3 show possible ways to seal the side openings, including snaps 36 and hook and loop closures 38. Other means of closures could include use of buttons, ties, zippers, or other conventional closure means.

In order to understand the advantage of inserting a duvet into a duvet sleeve of the invention, as opposed to a single opening duvet cover of the prior art, one needs to first understand how a duvet is inserted into a duvet cover in the prior art.

In a duvet cover of the prior art, an opening is provided on one side and one side only of the four edges of the duvet sleeve. Through this opening, the duvet is either inserted or removed. The hard part in inserting a duvet inside the duvet cover and having all four corners of the duvet extend to the boundaries of the four corners of the duvet cover. This is achieved in a couple of different ways. When two people are available, the duvet is inserted into the duvet cover enough so that one corner of the duvet is placed in one corner of the duvet cover. Then one person pinches the duvet cover from the outside to secure the duvet corner in place. Each of the duvet corners are positioned inside the corners of the duvet cover, and held in place by one of the four hands of two people. Once all four corners are thus secured, the two people can hold the duvet by the four corners and by pulling the duvet cover tight, the wrinkles in the duvet itself are straightened out, and the duvet is satisfactorily positioned inside the duvet cover.

This is much more difficult to do when only one person is trying to change the duvet from inside a duvet cover. One way for one person to position a duvet inside a duvet cover is to first turn the duvet cover inside out. Then each of the four corners of the duvet are pinned in place, such as with a safety pin, with the pin being placed either on the inside or the outside of the duvet cover. Once the four corners are pinned in place in the appropriate position of the duvet cover, then the duvet cover with its attached duvet can gradually be turned right side out. This is a cumbersome project and a duvet that facilitates easier installation is needed.

Figure 4:
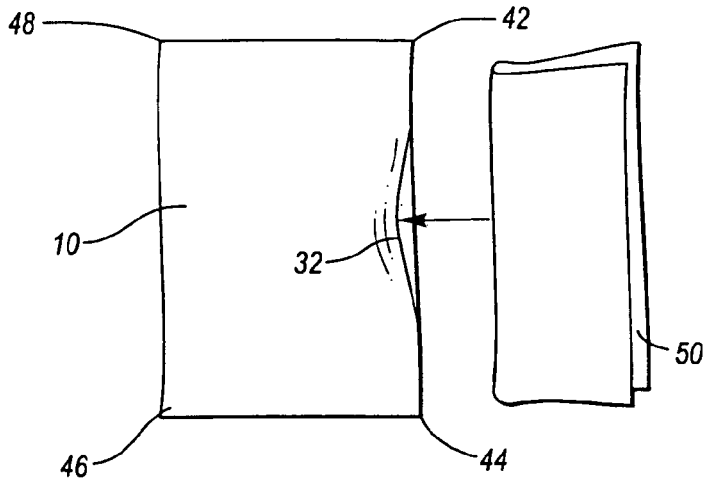
FIG. 4 is a top view of the side opening duvet sleeve of the invention.
Figure 5:
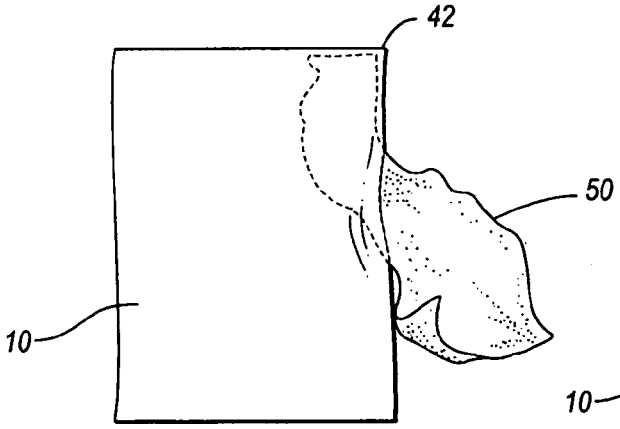
FIG. 5 is a top view of the side opening duvet sleeve of the invention with one corner of a duvet positioned.

To best understand how a duvet is inserted into the duvet sleeve 10 of the invention, the four corners of the duvet sleeve 10 are numbered 42, 44, 46 and 48, as shown in FIG. 4. As shown in FIG. 4, a duvet 50 is folded in half lengthwise as shown, for insertion into the duvet sleeve. The folded duvet 50 is inserted into a side opening 32 or 34 of the duvet sleeve of the invention. Once inside the duvet sleeve 10, the duvet 50 is positioned so that one corner of the duvet is positioned in a corner of the duvet sleeve 10 as shown in FIG. 5. In this figure the corner of the duvet 50 is positioned in the duvet sleeve corner 42.

Figure 6:
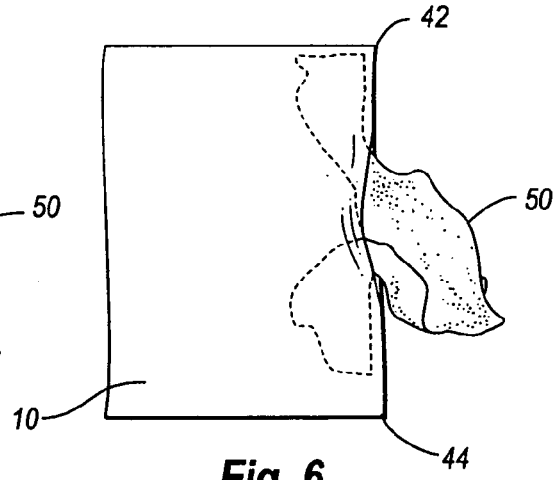
FIG. 6 is a top view of the side opening duvet sleeve of the invention with two corners of a duvet positioned.

The next step is shown in FIG. 6 in which another corner of the duvet 50 is positioned inside another corner of the duvet sleeve 10, corner 44. In this figure, the duvet 50 is positioned in corners 42 and 44. There is generally enough friction between the duvet 50 and the inside portion of the duvet sleeve 10 in order to immobilize the duvet 50 in the corner 42, while corner 44 is being placed.

Figure 7:
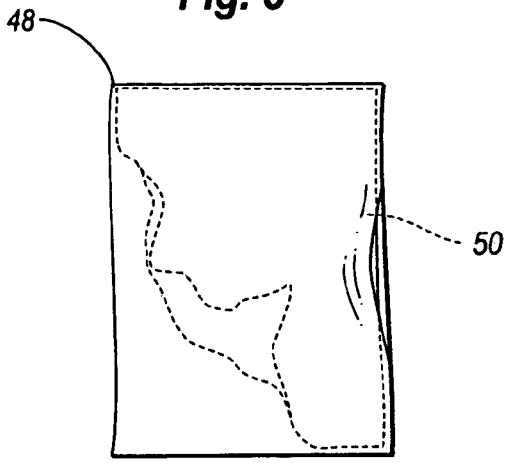
FIG. 7 is a top view of the side opening duvet sleeve of the invention with three corners of a duvet positioned.
Figure 8:
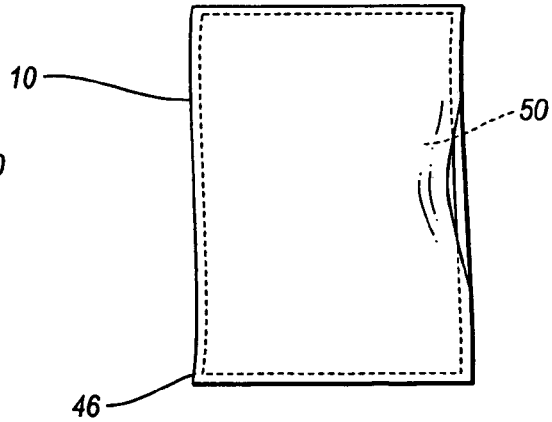
FIG. 8 is a top view of the side opening duvet sleeve of the invention with all four corners of a duvet in position.

FIGS. 7 and 8 show two more steps in which corners 48 in FIG. 7 and corner 46 in FIG. 8 are positioned. Generally, the previously positioned corners of the duvet 50 would stay in place, but if one of them had been dislodged, a person could go back and straighten it once all four corners had been generally positioned. Positioning a duvet 50 inside a duvet sleeve 10 in this matter is only possible because a duvet can be accessed from either side through the side openings 32 or 34. With these two side openings available for positioning a duvet, it becomes an extremely simple process, and one that one person can easily do without help. Without the two access positions of the invention, it is a much more difficult operation.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A dual side opening duvet sleeve for use in holding a duvet, comprising:

a first generally rectangular planar panel, configured for attachment to a corresponding second panel, with said first and second panels each having an upper side, a lower side, and a first and a second pair of opposing edges, said first opposing edges comprising a bottom edge opposite a top edge, and second opposing edges comprising a right edge opposite a left edge on each panel;

wherein said first panel lower side is positioned adjacent to said second panel upper side, forming a duvet sleeve interior, with said first and second pair of opposing edges of said first panel stitched to corresponding first and second pair of opposing edges of said second panel along at least a portion of said edges wherein said panels are joined only along their respective corresponding edges;

with two edges of said first panel being at least partially unattached to corresponding edges of said second panel, forming a first and second side opening in two edges between said first and second panels;

a first and second edge closure, for releasably joining said unattached panel edges of said first and second panels, said edge closures being provided only along opposed edges of said panels;

thereby providing access to said duvet sleeve interior through said first and second side openings for placement of said duvet, with said side openings being releasably joinable to allow insertion or removal of said duvet.

2. The side opening duvet sleeve of claim 1, in which said first and second side openings occupy a portion of said first opposite edges of said panels, and part of said first opposite edges of said first and second panels are joined.

3. The side opening duvet sleeve of claim 1, in which said side openings occupy a portion of said second opposite edges of said panels, and part of said second opposite edges of said first and second panels are joined.

4. The side opening duvet sleeve of claim 1, in which said side openings occupy approximately one third or less of the length of said edges of said panels, and approximately two thirds of said edges of said first and second panels are joined.

5. The side opening duvet sleeve of claim 2, in which said side openings occupy approximately one third or less of the length of said first pair of opposite edges of said panels, and approximately two thirds of said edges of said first pair of opposite edges of said first and second panels are joined.

6. The side opening duvet sleeve of claim 3, in which said side openings occupy approximately one third or less of the length of said second pair of opposite edges of said panels, and approximately two thirds of said edges of said second pair of opposite edges of said first and second panels are joined.

7. The side opening duvet sleeve of claim 2, in which said side openings are positioned centrally on said first pair of opposite edges.

8. The side opening duvet sleeve of claim 3, in which said side openings are positioned centrally on said second pair of opposite edges.

9. The side opening duvet sleeve of claim 1 in which said edge closures are snaps built in to the panel edges at said side openings.

10. The side opening duvet sleeve of claim 1 in which said edge closures are hook and loop closures built in to said panel edges at said side openings.

11. A dual side opening duvet sleeve for use in holding a duvet, comprising:

a first generally rectangular planar panel, configured for attachment to a corresponding second panel, with said first and second panels each having an upper side, a lower side, and a first and a second pair of opposing edges, said first opposing edges comprising a bottom edge opposite a top edge, and second opposing edges comprising a right edge opposite a left edge on each panel;

wherein said first panel lower side is positioned adjacent to said second panel upper side, forming a duvet sleeve interior, with said first and second pair of opposing edges of said first panel stitched to corresponding first and second pair of opposing edges of said second panel along at least a portion of said edges wherein said panels are joined only along their respective corresponding edges;

a pair of opposite edges of said first panel being at least partially unattached to corresponding edges of said second panel, forming a first and second side opening in two edges between said first and second panels on said pair opposite edges;

a first and second edge closure, for releasably joining said unattached panel edges of said first and second panels for access, said edge closures being provided only along opposed edges of said panels;

thereby providing access to said duvet sleeve interior through said first and second side openings for placement of said duvet, with said side openings being releasably joinable to allow insertion or removal of said duvet.

12. The side opening duvet sleeve of claim 11, in which said side openings occupy approximately one third or less of the length of said pair of opposite edges of said panels on which they are located, and approximately two thirds of said opposite edges are joined.

13. The side opening duvet sleeve of claim 11, in which said side openings are positioned centrally on said first pair of opposite edges.

14. The side opening duvet sleeve of claim 11 in which said pair of opposing edges in which said side openings are located are said left edges and said right edges of said duvet cover sleeve.

* * * * *